United States Patent [19]

Hayashi et al.

[11] Patent Number: 4,877,141

[45] Date of Patent: Oct. 31, 1989

[54] PRESSURE RESISTANT BOTTLE-SHAPED CONTAINER

[75] Inventors: Yoshiaki Hayashi, Matsudo; Takeshi Itakura, Adachi; Toyoji Kato; Yukio Koshidaka, both of Matsudo, all of Japan

[73] Assignee: Yoshino Kogyosho Co., Ltd., Tokyo, Japan

[21] Appl. No.: 155,732

[22] Filed: Feb. 16, 1988

[30] Foreign Application Priority Data

Oct. 3, 1986 [JP] Japan ..... 61-235865
Feb. 17, 1987 [JP] Japan ..... 62-34008
Feb. 17, 1987 [JP] Japan ..... 62-34007

[51] Int. Cl.[4] ..... B65D 23/00

[52] U.S. Cl. ..... 215/1 C; 220/72; D9/351; D9/394; D9/398; D9/405; D9/407

[58] Field of Search ..... D9/391, 390, 394–399, D9/400–413, 350, 351, 355; 215/1 C, 1 R; 220/72, 71

[56] References Cited

U.S. PATENT DOCUMENTS

| | | | |
|---|---|---|---|
| D. 75,499 | 6/1928 | Jester | D9/394 |
| D. 95,703 | 5/1935 | Richardson | D9/407 |
| D. 171,647 | 3/1954 | Hills . | |
| D. 191,544 | 10/1961 | Bloch | D9/407 |
| D. 207,803 | 5/1967 | Du Pree | D9/401 |
| D. 209,928 | 1/1968 | Linn, Jr. . | |
| D. 212,669 | 11/1968 | Weckman . | |
| D. 229,541 | 12/1973 | Anderson . | |
| D. 240,800 | 8/1976 | Jespersen | D9/408 |
| D. 261,864 | 11/1981 | Abramo . | |
| D. 287,934 | 1/1987 | Harris, Jr. | D9/401 X |
| 3,225,950 | 12/1965 | Josephsen et al. . | |
| 3,325,031 | 6/1967 | Singler . | |
| 3,397,724 | 8/1968 | Bolen et al. . | |
| 3,499,567 | 3/1970 | Spotts . | |
| 3,536,223 | 10/1970 | Muhlhoff et al. . | |
| 3,558,001 | 1/1971 | Fritz et al. | 220/72 X |
| 3,708,082 | 1/1973 | Platte . | |
| 3,926,341 | 12/1975 | Lhoest . | |
| 3,931,074 | 1/1976 | Gomez . | |
| 4,298,045 | 11/1981 | Weiler . | |
| 4,318,882 | 3/1982 | Agrawal et al. . | |
| 4,372,455 | 2/1983 | Cochran . | |
| 4,379,099 | 4/1983 | Ota et al. . | |
| 4,387,816 | 6/1983 | Weckman . | |
| 4,446,969 | 5/1984 | Tyler | 220/72 X |
| 4,497,855 | 2/1985 | Agrawal et al. . | |
| 4,589,560 | 5/1986 | Harris, Jr. . | |
| 4,749,092 | 6/1988 | Sugiura et al. | 215/1 C |
| 4,802,295 | 2/1989 | Darr | 215/1 C X |
| 4,805,788 | 2/1989 | Ota | 215/1 C |

FOREIGN PATENT DOCUMENTS

| | | | |
|---|---|---|---|
| 0198587 | 10/1986 | European Pat. Off. . | |
| 293908 | 8/1916 | Fed. Rep. of Germany . | |
| 90987 | 3/1968 | France . | |
| 2595067 | 9/1987 | France . | |
| 57126310 | 8/1962 | Japan . | |
| 54-30654 | 2/1979 | Japan . | |
| D606383-4 | 8/1983 | Japan . | |
| 1059930 | 2/1967 | United Kingdom | 215/1 C |

*Primary Examiner*—Bryon P. Gehman
*Attorney, Agent, or Firm*—Oliff & Berridge

[57] ABSTRACT

A pressure resistant bottle-shaped container having a body including panels surrounded by outer sheaths, characterized in that each panel has stress absorbing strips comprising vertexes recessed from the outer surface of the panel toward the interior of the container and bending lines formed in V shape and inverted V shape from the vertexes toward the outer sheaths. Thus, the container does not retain permanent deformation by the deformations resulting from pressure changes at the time of filling high temperature liquid content.

5 Claims, 7 Drawing Sheets

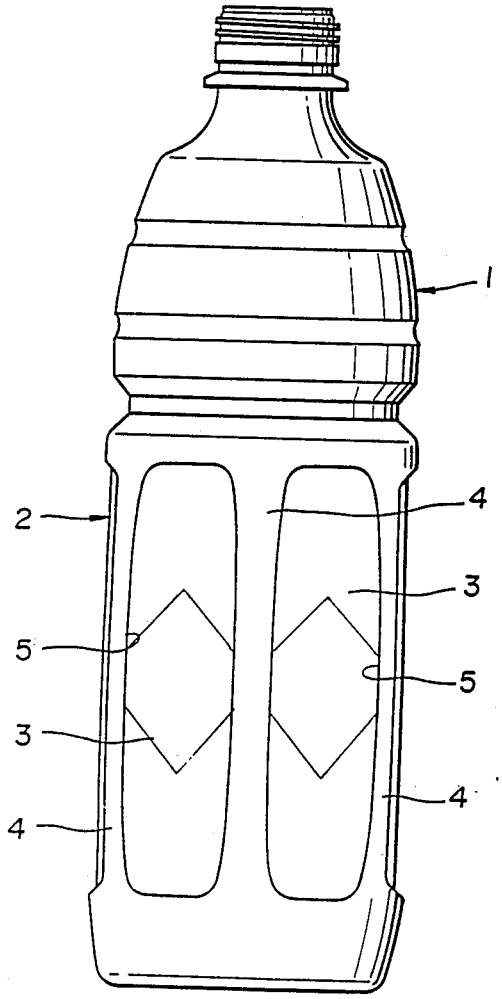
1
2
4
3
5
5
3
4
4

PRESSURE RESISTANT BOTTLE-SHAPED CONTAINER

BACKGROUND OF THE INVENTION

1. Field of the Invention

This invention relates to a blow-molded bottle-shaped container of biaxially oriented polyethylene terephthalate resin and, more particularly, to a bottle-shaped container in which large durable strength is created against an increase in the pressure in the bottle-shaped container but which is easily and uniformly deformed under reduced pressure in the container.

2. Related Art

It is known that a blow-molded bottle-shaped container of biaxially oriented polyethylene terephthalate resin (hereinafter referred merely to as "PET") is improved in the heat resistance of the container body itself by heat setting the resin after biaxial-orientation blow-molding to provide a heat resistant bottle-shaped container for filling content liquid necessary to be filled at high temperature, such as juice drink.

However, the bottle-shaped container of PET of this type does not have high rigidity like a glass or metal bottle-shaped container, but is flexible. Thus, the body of the bottle-shaped container is improperly deformed under reduced pressure generated in the container due to a volumetric contraction of content liquid or a decrease in the vapor pressure of a head space when filling the content liquid at high temperature to cause the container to be remarkably defected in its external appearance.

The bottle-shaped container of the PET of this type is prevented from being deformed in the configuration of the body by recessing and aligning flat longitudinal reduced pressure absorbing panels on its body to absorb the reduced pressure in the container by means of the panels.

Pressure and stress are acted on the panels of the heat resistant bottle-shaped container of the PET as below. Hydraulic pressure produced due to the difference in height of the surface of the content liquid filled in the container from the content liquid in a tank disposed at its upper position at the time of pressing to seal the neck of the container and filling the liquid content in the container by a filling machine in case of filling the content liquid at high temperature is acted on the panels of the container. The hydraulic pressure is opened with the atmospheric pressure immediately after filling the content liquid in the container. A rise in the internal pressure in the container due to vapor pressure in the head space of the container at the time of capping the neck of the container (e.g., the internal pressure in the container is raised to approximately 1.7149 kg/cm$^2$ when the content liquid of 90° C. is, for example, filled in the container). The vapor pressure in the container is reduced gradually from the state at capping time to the atmospheric pressure at sterilization time, and the pressure in the container is decreased in the deforming stress in response to the pressure change caused by the content from being reduced in volume at cooling time and to the reduction in the vapor pressure in the head space of the container. The deforming stresses are generated at the panels in response to the pressure change.

As described above, the panels are affected by the heat from the content liquid in the container and also subjected to the pressure change at pressurizing time (at the time of filling the content or capping the neck of the container), to the ambient pressure (immediately after filling the content liquid in the container) or to the pressure reduction (at the time of cooling the container). Therefore, the panels are heated to high temperature and pressurized to high pressure at the time of filling the content in the container, capping the neck of the container due to the vapor pressure and the heat of the content liquid immediately thereafter, and thus extrusion-deformed in a raised shape at the outside of the container as compared with that at the time of vacant container.

According to a number of experiments, generated vapor pressure is relatively low when the temperature of the content liquid to be filled is 80° C. or lower, so that the temperature rising degree of the container is less. Thus, the allowable stress to the container itself is still large, a trend that the panels are deformed in a raised shape is relatively small, and the influence of the raised deformation of the panel is not almost presented after cooling the container. However, when the temperature of the content liquid is 85° C. or higher and particularly 90° C. or higher, generated vapor pressure in the container is raised, and the raised deformation of the panel after capping the neck of the container is much increased.

Since the raised deformation of the panel of the container is affected by the influences of the temperature of the content liquid and the vapor pressure of the container, a permanent strain remains in the material of the container due to a decrease in the strength of the material and the remaining strain.

The panels provided on the bottle-shaped container of this type are heretofore composed, in order to obtain uniform deformation, of (1) flat surfaces as large as possible on the entire area of the panels, (2) external projections of the entire panel in advance, (3) external protrusion of partial panel in advance, (4) inclined surfaces of the panels to reduce the raised deformation, (5) recess grooves surrounded on the panels to scarcely cause the panels to be deformed in a raised shape, and (6) lateral and longitudinal rib strips formed on the panels. However, when the temperature of the content liquid filled in the container is actually raised to 85° C. or higher, raised deformations indispensably generated on the panels are increased due to the influences of the heat and vapor pressure of the liquid content in the container, and permanent deformations remain at the panel as remaining strains at the time of cooling the container. The panels which have once been subjected to the raised permanent deformations cannot function as ordinary panels and lose their reduced pressure absorbing action. Thus, the entire body of the container is improperly deformed to triangular or elliptical shape, or the panels cannot absorb the normal pressure reduction, thereby causing the external appearance of the container to be deteriorated.

As described above, it is also known that panels which cause less raised deformation against an increased pressure at the time of capping the neck of the container and also cause easy deformation due to recessed deformation under reduced pressure in the container at the time of cooling the container are formed in flat structure in the whole inside of the stepped portion of the panels surrounded by bent stepped portions on the periphery. However, mere flat structure of the entire panel causes the stepped portions to be subjected to permanent deformations as will be described so that the panels cannot absorb deformations due to normal reduced pressure. Even if the panels may absorb the reduced pressure deformation, the available state of the stress acting on the panels due to the reduced pressure cannot be specified to be uniformized. Thus, predetermined stable deformations cannot be proceeded at the panels. In this manner, the degrees of absorbing the deformation due to reduced pressure in the panels become different, so that the external appearance of the bottle-shaped container is abnormally deteriorated.

The most simple means which do not retain permanent deformations in the raised strains of the panels is to raise the heat setting effect of the container. The heat setting includes biaxial-orientation blow-molding a preformed piece by injection molding, then cooling the piece, then heating again the piece to remove its remaining stress, and thereafter further blowing the piece to complete a product. However, in order to raise the heat setting effect of the bottle-shaped container, it is necessary to raise the heat setting temperature and to increase the setting time. Thus, the heat setting remarkably reduces the productivity. Therefore, a method of raising the heat setting is not practical. Even if the container is sufficiently heat set in this manner, the deformation for the reduced pressure absorbing effects of the panels cannot be always uniformly generated, but a decrease in the external appearance of the container due to irregular deformation still remains unsolved.

Since blow-molded bottle-shaped container of biaxially oriented synthetic resin is removed from a metal mold in the state the container is yet soft after blow-molding, the container is feasibly deformed due to small remaining distortion. This distortion of the container is understood to be largely affected by the structure of the panels. The bottle-shaped container having conventional panels as described above has remarkable drawbacks to be readily deformed in its structure after blow-molding.

The causes of the permanent deformation of the panel in the bottle-shaped container have been observed in detail. It is discovered that one of the causes resides in the fact that the bending angles of two bent portions of the stepped portions bent at the periphery of the panels are varied in opposite directions each other to be different from the angle at the time of molding.

The variations in the bending angles of the two bent parts of the stepped portions was understood from the fact that permanent deformations occurred due to the excess of allowable range of the deformations varied in opposite directions at the two bent parts by the temperature and the vapor pressure of the liquid content to be filled. When the stepped portions are thus deformed, the entire panels remain deformed in raised shape, resulting in impossibility of smoothly recessed distortion for absorbing reduced pressure in the container.

In a cylindrical bottle-shaped container, the body is located at equal distances from the center line at any portion. Thus, the container is easily uniformly oriented. However, in a polygonal bottle-shaped container, the body is not located at equal distances from the center line; according to the positions, the container is subjected to irregular orientations Therefore, the amounts of orientations are different at the positions on the container. Thus, internal remaining stresses generated by blow-molding are at different positions on the body. The differences in the blow-molding cause the panels to be subjected to permanent deformations at the time of heat setting or completing the container. This is also remarkable particularly at the bottom of the container at the portions which are most feasibly affected by the orientations.

SUMMARY OF THE INVENTION

Accordingly, it is an object of this invention to provide a blow-molded bottle-shaped container of biaxially oriented synthetic resin which can eliminate the drawbacks and inconvenience of the conventional bottle-shaped container described above and does not remain permanently deformed by the deformations corresponding to pressure changes at the time of filling high temperature liquid content.

In order to achieve the above and other objects, there is provided according to the present invention a pressure resistant bottle-shaped container (1) comprising a body including a plurality of panels (3) surrounded by outer sheaths (5), whereby each panel (3) has a plurality of stress absorbing strips formed to have vertexes (6, 23) recessed from the outer surface of the panel toward the interior of the container, and bending lines (7, 24) formed in V shape and inverted V shape from the vertexes (6, 23) toward the outer sheaths (5).

The foregoing object and other objects as well as the characteristic features of the invention will become more fully apparent and more readily understandable by the following description and the appended claims when read in conjunction with the accompanying drawings.

BRIEF DESCRIPTION OF THE DRAWINGS

FIG. 11 is an entire external view of a large-sized blow-molded bottle-shaped container of biaxially oriented polyethylene terephthalate resin used in the embodiment of FIGS. 2 and 3.

DESCRIPTION OF THE PREFERRED EMBODIMENTS

Figure 1:
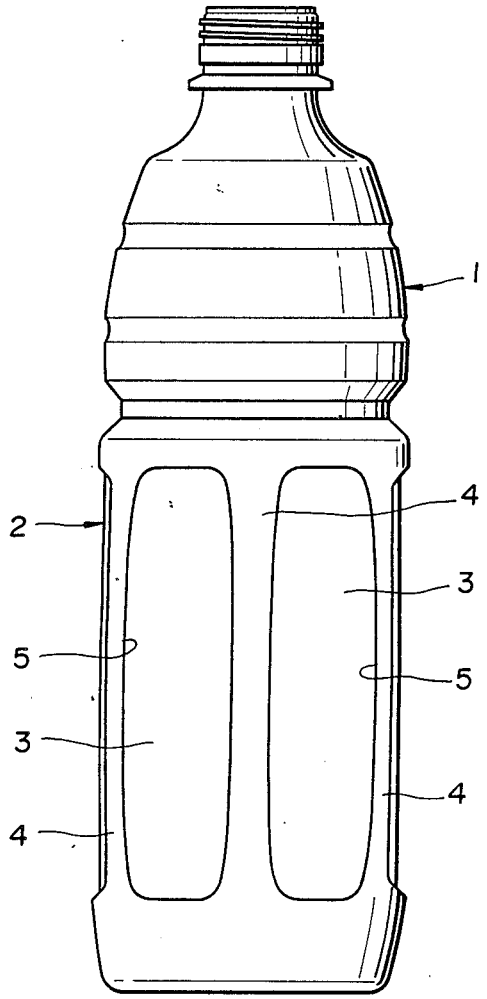
FIG. 1 is an entire external view of a large-sized blow-molded bottle-shaped container of biaxially oriented polyethylene terephthalate resin used in the first to forth embodiments of the present invention.

Embodiments of a pressure resistant bottle-shaped container according to the present invention will be described with reference to the drawings.

A bottle-shaped container 1 used in the present invention comprises a body 2. The body 2 has a plurality of panels 3 disposed in parallel longitudinally of the body 2, each panel having a longitudinal height and a transverse width, and a plurality of ribs 4 provided between the panels 3. In the container 1 used in first and second embodiments, outer sheaths 5 of the panels 3 have stepped portions Each panel 3 is formed with a plurality of stress absorbing zones. Each stress absorbing zone has vertexes 6 recessed from the outer surface of the panel 3 toward the interior of the container 1, and bending lines 7 formed in V shape and inverted V shape from the vertexes 6 toward the outer sheaths 5.

In the first embodiment of the bottle-shaped container of the invention, each vertex 6 is formed on the center line M of the panel 3 along an imaginary line located along the longitudinal direction of the panel 3, and is defined by bending lines 7. Reference numeral 8 designates a flat portion recessed from the outer surface of the body toward the interior of the container 1 from the panel surface between the bending lines 7 and 7 to be formed flat. The flat portion 8 is disposed at the longitudinal center of the panel 3. The recessing step of the bending line 7 is defined to be 1.0 mm or less. A portion 9 outside the flat portion 8 of the panel 3 is defined as a deforming portion.

Since the bending lines 7 are formed through the vertexes 6 on along the center line M in mirror-image, confronting relationship, the stress, when reduced pressure is acted on the panel 3 so that a stress for the deformation is generated, is concentrated at the vertexes 6 along the bending lines 7. Thus, the panel 3 is deformed so as to absorb the reduced pressure from the position disposed at the vertex 6.

Since the flat portion 8 is disposed between a pair of bending lines 7 and 7, the flat portion 8 is affected by the deforming forces at both upper and lower ends of the lateral center when the stress is concentrated at the vertexes 6 due to the reduced pressure deformation. Thus, the reduced pressure deformation is smoothly and reliably absorbed at the flat portion 8 to be always in constant degree.

Since the flat portion 8 is disposed a the longitudinal center of the panel 3, the reduced pressure deformation is absorbed at the center of the panel 3. Thus, the deformation caused due to the reduced pressure absorption of the panel 3 is not irregular, but is generated entirely in order.

Since the step distance of the bending lines 7 is set to 1.0 mm or less, the interval of the two bending portions for forming the bending lines 7 is narrowed in a wall sectional structure. Thus, the wall sectional structure of the bending lines is hardly deformed irrespective of the pressure increase or decrease and the temperature of the content liquid contained in the container 1.

Therefore, even if the pressure increase at the time of capping the neck of the container 1 and the temperature of the content liquid in the container 1 at the time of filling the liquid in the container 1 are acted at the bending lines 7, the bending lines 7 are not permanently deformed nor permanently raised to be deformed at the panel 3.

Thus, even if the pressure increase at the time of capping the neck of the container 1 and the high temperature of the liquid content to be filled in the container 1 are effected at the bending lines 7, the bending lines 7 are not permanently deformed, nor the panel 3 is permanently deformed in a raised shape.

The flat portion 8 of the container 1 is scarcely affected by the remaining stresses from the deforming portion 9 and the rib 4 at the periphery of the container at the time of biaxial-orientation blow-molding the container 1 due to the presence of the bending lines 7. Therefore, the dimensional accuracy of the flatness of the panel 3 is increased at the time of heat setting the container 1 to suppress the increase in the irregularity due to filling of the liquid content at high temperature in the blow-molded container 1, thus manufacturing the container 1 of high quality.

EXAMPLES

A bottle-shaped container 1 was made of PET by standard biaxial-orientation blow-molding having 0.33 to 0.35 mm of thickness at a body 2. The relationship between the steps of the bending lines 7 and the deformation of the panel 3 was observed by variably altering the steps of the bending lines 7 in the panel 3 of the container 1 in case of filling specified amount of hot water at 90° C., overturning the container 1 for 30 seconds after capping the neck of the container 1, allowing the container 1 to stand for 5 minutes and 30 seconds in an erected attitude, then cooling it to room temperature with cold water, and the following results were obtained.

2.0 mm of step of bending lines 7

The swelling deformation of the panel 3 after capping the neck of the container was large, the deformations of the bending lines 7 due to the deformation of the panel became permanent, and reduced pressure absorbing deformation of the panel 3 became improper at the time of cooling.

1.2 mm of step of bending lines 7

The swelling deformation of the panel 3 after capping the neck of the container was ordinary, the deformations of the bending lines 7 due to the deformation of the panel became permanent, and reduced pressure absorbing deformation of the panel 3 did not smoothly occur at the time of cooling.

1.0 mm of step of bending lines 7

The swelling deformation of the panel 3 after capping the neck of the container was relatively small, the deformations of the bending lines 7 due to the deformation of the panel became less permanent, and reduced pressure absorbing deformation of the panel 3 did not become irregular to cause the external appearance of the container 1 to be defected at the time of cooling.

0.7 mm of step of bending lines 7

The swelling deformation of the panel 3 after capping the neck of the container was small, the deformations of the bending lines 7 due to the deformation of the panel almost did not occur, and reduced pressure absorbing deformation of the panel 3 became very smooth and uniform at the time of cooling.

0.5 mm of step of bending lines 7

The swelling deformation of the panel 3 after capping the neck of the container was substantially the same as the case of 0.7 mm of the step of the bending lines 7, the deformations of the bending lines 7 due to the deformation of the panel also became not permanent, and reduced pressure absorbing deformation of the panel 3 became extremely smooth and uniform at the time of cooling.

From the experiments, it is confirmed that the step of the bending lines 7 formed on the panel 3 necessary to be deformed for absorbing the reduced pressure in the container 1 must be 1.0 mm or shorter.

The flat portion 8 formed on the panel 3 is a main portion for stabilizing the deforming state of the panel 3.

According to various experiments, the area of the flat portion 8 is preferably approximately one-fourth of the area of the entire panel 3.

Further, the bending lines 7 for concentrating the stress generated by the external pressure acting on the panel 3 at the vertexes 6 are preferably necessarily disposed obliquely with respect to the center line M. In other words, the bending lines 7 must be formed in V shape or in inverted V shape with respect to the center line M as a center. The angle of the V-shaped bending lines 7 is preferably approximately 30° to 140°. If the angle is smaller than 30°, the concentrating degree of the stress generated to the vertex 6 is excessively strengthened to cause the deformation of the flat portion 8 to become near the bending deformation, thus causing a trend of concentrating the deformation on the flat portion 8. On the contrary, if the V-shaped angle is larger than 140°, the concentration of the generated stress at the vertex 6 is deteriorated to cause the uniform deformation of the panel 3 to be deteriorated.

Figure 2:
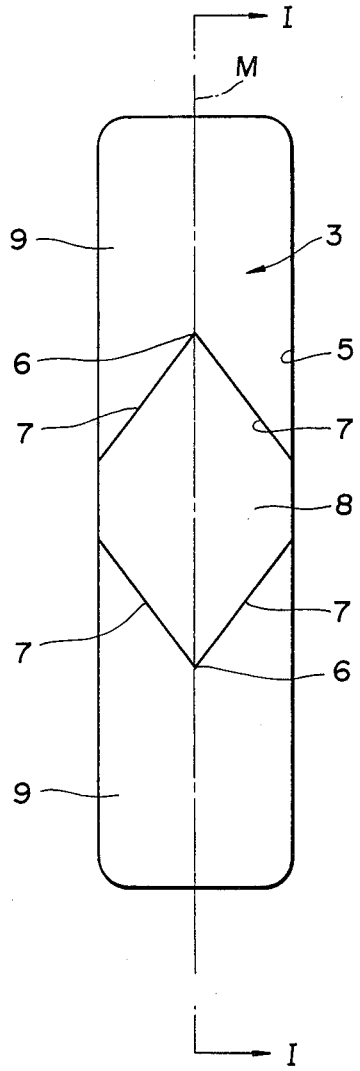
FIG. 2 is a front view of a panel of a bottle-shaped container according to the first embodiment of the present invention.
Figure 3:
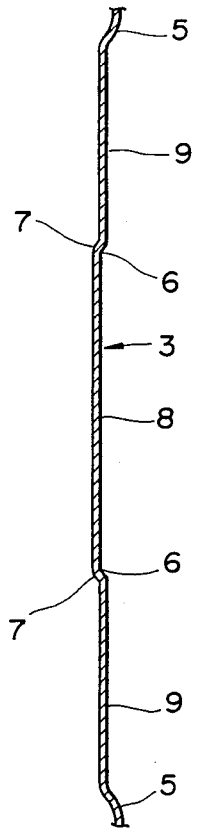
FIG. 3 is a sectional view taken along the line I—I in FIG. 2.

In the first embodiment of the invention in FIGS. 2 and 3, the vertexes 6 are disposed at the trisections of the longitudinal sides of the panel 3, and the V-shaped angle of the vertexes 6 is set to approximately 80°, and the step of the bending lines 7 is set to 0.7 mm.

In this first embodiment, the raised deformation due to the increased pressure at the time of capping the neck of the container was performed mainly at the deforming portion 9, and the raised deformation of the fat portion 8 was small. In case of reduced pressure absorbing deformation, the flat portion 8 was largely recessed to be deformed, the deforming portion 9 was largely bent in the state pulled by the recessed deformation of the flat portion 8, and the entire panel 3 was deformed constantly.

Figure 4:
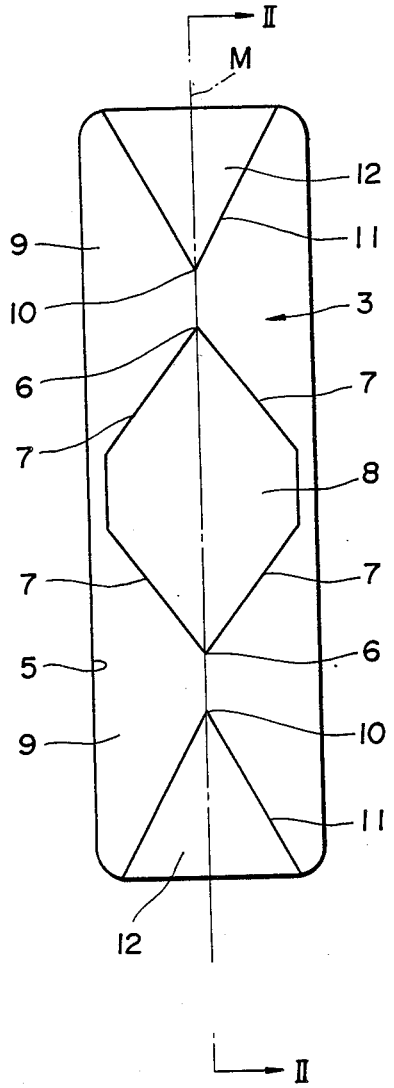
FIG. 4 is a front view of a panel for a second embodiment of a bottle-shaped container
Figure 5:
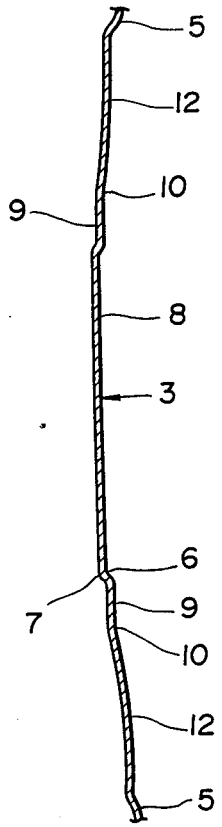
FIG. 5 is a sectional view taken along the line II—II of FIG. 4.

In the second embodiment in FIGS. 4 and 5, the flat portion 8 of the first embodiment in FIGS. 2 and 3 is completely bordered by the bending lines 7. Further, bending lines 11 intersect second vertexes 10, the bending lines are formed in a V shape and inverted V shape, the V shape and inverted V shape each being open toward the longitudinally adjacent outer sheath, the second vertexes 10 are formed on the center line outside of the flat portion 8 at each longitudinal end thereof, as bending points are formed at both deforming portions 9, the deforming portions 9 are partly obliquely raised toward the outer sheaths 5 to form an auxiliary deformation 12 of a bending wall structure.

In this second embodiment, the swelling deformation of the deforming portions 9 with respect to the increased pressure at the time of capping is suppressed. Thus, the swelling deformation of the entire panel 3 at the time of capping is reduced, and no permanent deformation is generated at the step 5 for forming the boundary between the panel 3 and the rib 4. Since the stresses are concentrated to some degree to the vertexes 6 at both ends of the flat portion 8 and the second vertexes 10 of the deforming portions 9 at the time of reduced pressure absorbing deformation, the deforming states of the deforming portions 9 can be uniformized, thus obtaining more stable reduced pressure absorbing deformations of the panel 3.

A third embodiment of the present invention will be described with reference to FIGS. 6 and 7.

Figure 6:
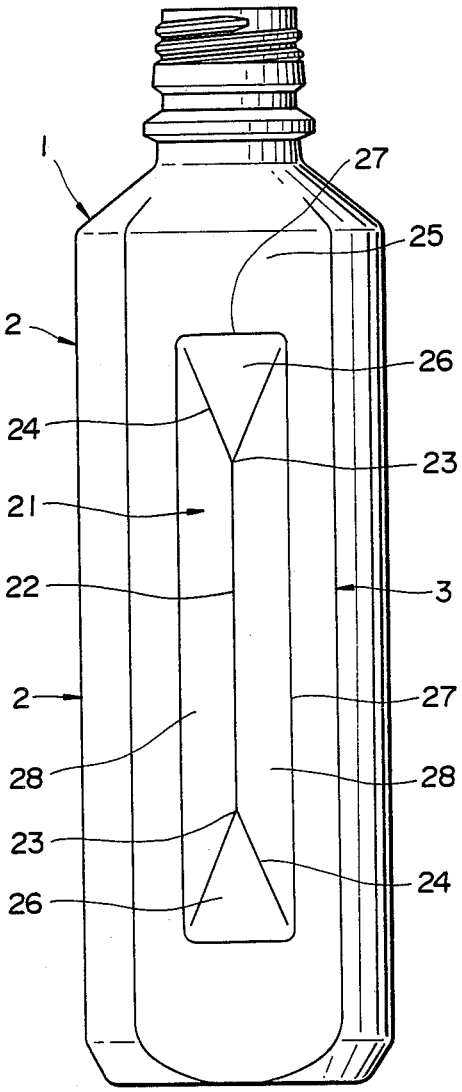
FIG. 6 is a front view of a bottle-shaped container of a third embodiment of the invention.
Figure 7:
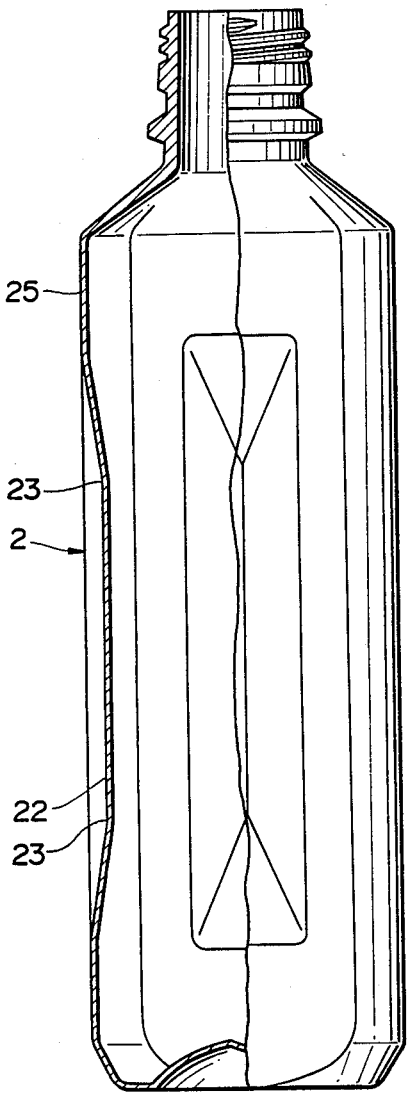
FIG. 7 is a partial sectional front view of the third embodiment.

A bottle-shaped container 1 in FIGS. 6 and 7 comprises a body 2 of substantially square-shaped section and made of four panels 3. Each panel 3 includes a deforming portion 21. In this third embodiment, a linear bottom line 22 is formed longitudinally in the deforming portion 21. Valley lines (bending lines) 24 are formed in V shape or inverted V shape from vertexes 23 at both ends of the bottom line 22.

The bottom line 22 is formed by inwardly recessing the outer surface 25 of the body 2. Oblique walls 26 are formed in inclined portions between the outer sheaths 27 of the deforming portion 21 and the valley lines (bending lines) 24, and the oblique walls 28 are formed in inclined portions formed between the sheaths 27 of the deforming portion 21 and the valley lines (bending lines) 24, and the bottom line 22. In other words, the deforming portion 21 is formed of the oblique walls 26, 26, and the oblique walls 28, 28.

When liquid content is filled in the bottle-shaped container 1 having the panels 3 including the deforming portions 21 or the neck of the container 1 is capped to apply pressure from inside to the container 1, the oblique walls 26, 28 formed obliquely toward the bottom line 22 are swelled to be deformed by externally depressing in the state that the bottom line 22 recessed is raised by the applied pressure, thus deforming no other portion of the container 1.

In this third embodiment, the bottom line 21 and the valley lines (bending lines) 24 are formed inwardly into the interior of the container as described above largely different from the conventional panel. Thus, the deformations against the pressure appled to the deforming portion 21 and the deformations particularly due to the reduced pressure in the container can be smoothly and efficiently performed.

In the conventional panel, the deforming portion 21 is externally protruded or formed flatly. Thus, it is necessary to inwardly deform inversely the deforming portion 21 or to deform similarly to the inward deformation when reduced pressure occurs in the container 1. When insufficient strength necessary to inversely deform the deforming portion 21 occurs, the deformation is failed, thus causing the deforming portion to be partly largely deformed or the portion except the deforming portion 21 to be unpreferably deformed to lose the external appearance of the container. In the present invention, in case that the reduced pressure occurs in the container, the deforming portion 21 is not inversely deformed due to the advantageous configuration not to deform unnecessarily, this embodiment can eliminate the disadvantages of the conventional panel 3.

Further, it is discovered that no deformation occurred when removing the container having the panels 3 according to the invention from the metal mold after blow-molding.

The body shape of the bottle-shaped container in FIGS. 6 and 7 is of substantially square shape. However, the present invention is not limited to the particular embodiment, and is not used only for the container of rectangular shape, but may be formed in the bottle-shaped container of polygonal and circular cross-sectional shape, as shown in FIG. 1.

The ratio of the length of the bottom line 22 with respect to the deforming portion 21 is not limited. In the embodiment in FIGS. 6 and 7, the length of the bottom line 22 is set to approximately 1/1.7 of the longitudinal length of the deforming portion 21, and disposed at the center of the deforming portion 21. The lengths of the valley lies (bending lines) 24 are determined according to the length of the bottom line 22.

Figure 8:
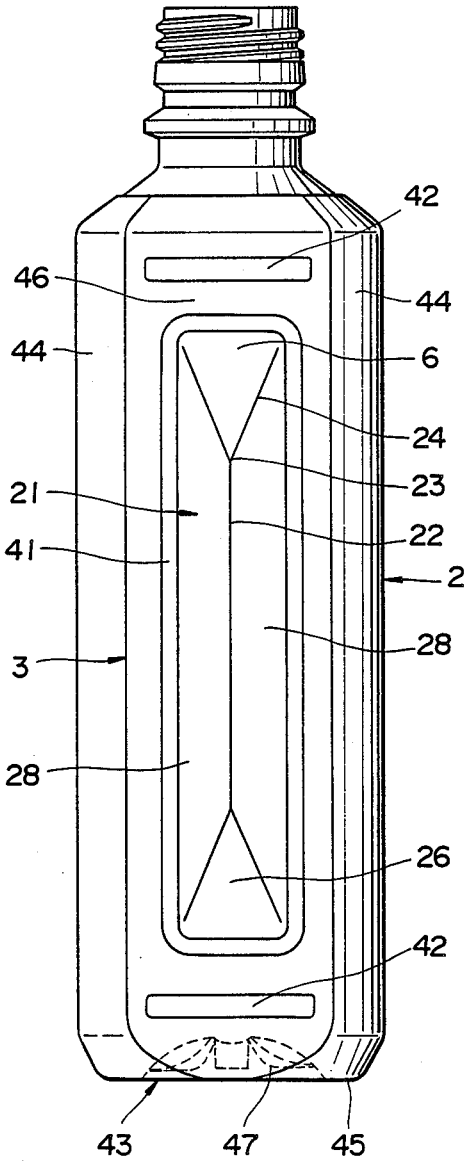
FIG. 8 is a front view of a bottle-shaped container of fourth and fifth embodiments of the invention.
Figure 9:
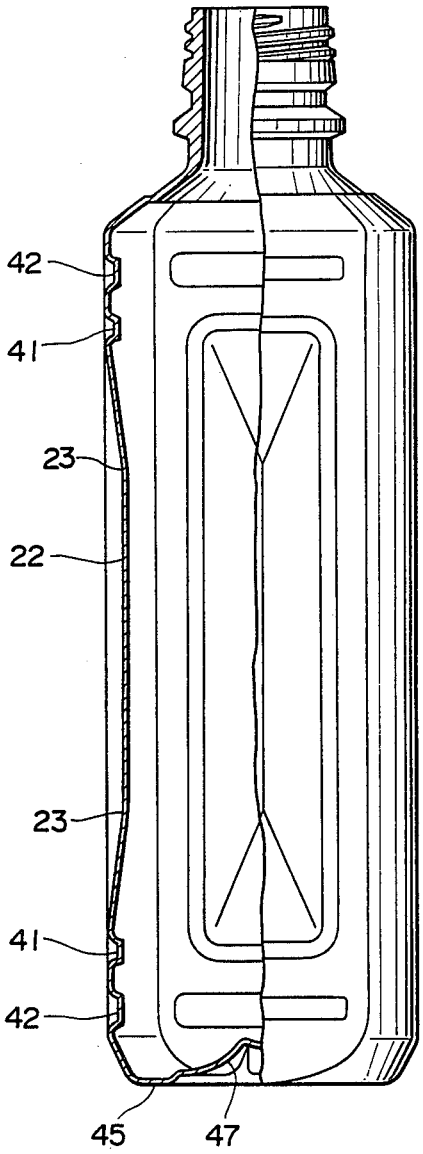
FIG. 9 is a partial sectional front view of a bottle-shaped container of the fourth and fifth embodiments of the invention; 10

In a fourth embodiment of the invention in FIGS. 8 and 9, a deforming portion 21 is surrounded by a recessed groove 41. The groove 41 strengthens the rigidity of the body 2 of the bottle-shaped container 1. The groove 41 strengthens the rigidity of the body 2 to eliminate the deformation of the body 2 due to the pressure change in the container, thus sufficiently performing the function of the deforming portion 21.

The shape of the deforming portion 21 formed by surrounding it with the groove 41 is not limited to the rectangular shape, but may be formed in square, polygonal, circular or elliptical to be adapted for the shape of the body 2 of the container and other conditions.

The sizes and the forming positions of the groove 2 with the deforming portion 21 are not limited. In this fourth embodiment, it is largely formed at the center of the body 2 of the container 1 to provide large reduced pressure in the container 1.

Grooves 42 are formed above or below the panel 3 for the similar purpose to that of the groove 41.

Figure 10:
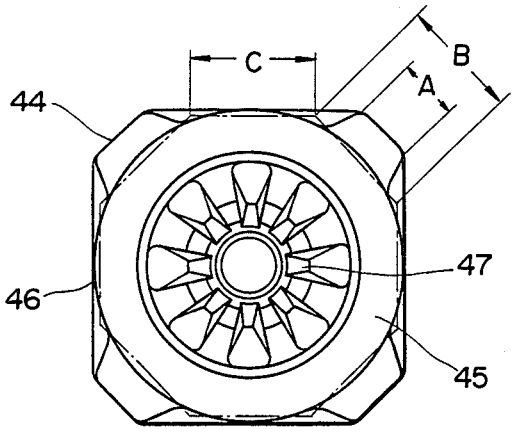
FIG. 10 is a bottom view of the container of the fifth embodiment of the invention.

The embodiment of the bottle-shaped container 1 in FIGS. 8 and 10 comprises a body 2 of substantially square sectional shape and a bottom wall 43. The body 2 is formed of four panels 3, and edges 44 formed between the panels 3. The sectional shape of the bottom surface 45 of the peripheral end of the bottom wall 43 is polygonal shape of integer number times of the number of the side surfaces 46 of the body 2.

The sectional shape of the bottom surface 45 of the bottom wall 43 is formed to be polygonal shape of the integer number times of the number of the side surfaces 46 of the body 2 (e.g., twice or four times of the number of the side surfaces 46 of the body 2), thereby approaching the sectional shape of the bottom surface 45 to circular shape. When approaching to the circular shape, the orientation of the bottom wall 43 becomes uniform, so that no permanent deformation (distortion) feasibly produced due to the irregular remaining stress at the time of heat setting or after completing the bottle-shaped container occurs.

The bottle-shaped container 1 in FIGS. 8 to 10 comprises a body 2 of square-sectional shape and four side surfaces 46, and four edges 44 between the side surfaces. The edges 44 are set in width to approximately $\frac{1}{3}$ of the width of the edge 44. The present invention is not limited to the square shape, but may comprise all polygonal shapes, sch as hexagonal, octagonal shapes, etc. The sectional shape of the body 2 is preferably formed with $A/B=0.2$ or larger in FIG. 10. This is because the body 2 can be formed in more preferably uniform blow-molding. Here, A is the width of the edge 44, and B is the length of one side of the polygon of the bottom surface 45.

In order to approach the bottom surface 45 as near as a true circle, it is preferable to form the equal lengths of the sides in a regular polygonal shape because more uniform orientation blow-molding can be performed.

The planar shape of the bottom wall 43 of the bottle-shaped container 1 in FIGS. 8 to 10 is formed as a circle of infinite polygonal shape. However, as designated by a broken line in FIG. 10, it may be formed in octagonal shape of twice as large as the number of the side surfaces 46 of the body 2. In this case, the lengths of the sides are preferably equal in regular polygonal shape ($B=C$ in FIG. 10).

The bottom surface 45 is formed in a polygonal shape of the integer number times of the number or the side surfaces 46 of the body 2. This is preferably $2^x$ times as large as the number of the sides 46 of the body 2, where x is an integer number to form the bottle-shaped container 1.

In the embodiments described above, the center of the bottom wall 43 of the container 1 is inversely bent inwardly of the container 1, and reinforcing ribs 47 are formed at the inversely bent portions. Therefore, the orientation of the bottom wall 43 is increased, and the bottom wall 43 of the container is strengthened by utilizing the properties of the synthetic resin, such as polyethylene terephthalate resin, etc. to increase the mechanical strength and the heat resistance by orienting. The number and the shape of the reinforcing ribs 47 are not particularly limited, but suitably selected to perform the objects of providing sufficient mechanical strength and the heat resistance of the bottom wall 43.

Since the pressure resistance bottle-shape container according to the present invention is constructed as described above, the deformations of the panels are suppressed when the pressure in the bottle-shaped container is increased, and the panels are smoothly, uniformly and reliably recessed to be deformed when the pressure in the container is reduced. Since the bending lines are formed on the panels, the dimensional stability of the flat panels can be enhance at the time of heat setting the container. Further, when removing the bottle-shaped container from the metal mold after blow-molding the container, no deformation occurs at the panels. Since the surfaces of the body of the container is formed in a polygonal shape of the integer number times of the number of the side surfaces of the body in the cross sectional shape of the bottom of the container as the peripheral end of the bottom wall, orientations of the bottom walls are uniformized, resulting in no permanent deformation occurring at the time of heat setting or completing the container. Further, excellent external appearance of the bottle-shaped container may be provided by the features of the invention described heretofore.

What is claimed is:

1. A pressure resistant bottle-shaped container having a body with an outer surface including panels surrounded by outer sheaths, wherein:

each panel has a longitudinal height and a transverse width, and includes stress absorbing tones comprising vertexes recessed from the outer surface of the panel toward the interior of the container and bending lines formed, in V shape and inverted V shape in mirror-image, confronting relationship from the vertexes toward the outer sheaths, said vertexes are formed on the center line of the panel along the longitudinal height of the panel, a flat recessed portion is formed between the vertexes at the center of the longitudinal height of the panel, and a depth of a recessing step between the surface of the panel and the flat portion is 1.0 mm or less.

2. The pressure resistant bottle-shaped container according to claim 1, wherein the area of the flat portion is one-fourth of the area of the panel.

3. The pressure resistant bottle-shaped container according to claim 1, wherein the angle of the V shape of each bending lines is 30° to 140°.

4. The pressure resistant bottle-shaped container according to claim 1, wherein said vertexes are disposed at trisections of the longitudinal height of the panel, and each angle of the V shape of the bending lines is 80°, and the depth of said step is 0.7 mm.

5. The pressure resistant bottle-shaped container according to claim 1, wherein said flat portion is bordered by said bending lines, a second vertex is formed on the center line outside of the flat portion at each longitudinal end thereof, and a bending line intersects each second vertex, the bending lines are formed in a V shape and inverted V shape, the V shape and inverted V shape each being open toward the longitudinally adjacent outer sheath.

* * * * *